US006152430A

United States Patent [19]

Thoman

[11] Patent Number: 6,152,430

[45] Date of Patent: Nov. 28, 2000

[54] PORTABLE STANCHION HAVING INTERLOCKING BASE

[76] Inventor: Owen E. Thoman, 8480 Pharmer Rd., Gilroy, Calif. 95020

[21] Appl. No.: 09/276,769

[22] Filed: Mar. 25, 1999

[51] Int. Cl.[7] ..... E04H 17/14

[52] U.S. Cl. ..... 256/59; 256/65; 256/DIG. 5; 256/66; 256/67; 482/16; 248/188; 403/326; 403/329

[58] Field of Search ..... 119/705; 256/24, 256/29, 73, DIG. 5, 59, 65; 52/36.1, 292; 211/182, 189; 248/188, 244.7, 224.8; 403/326, 329, 330, 230, 231

[56] References Cited

U.S. PATENT DOCUMENTS

| | | | |
|---|---|---|---|
| 1,982,934 | 12/1934 | Squire | 482/16 |
| 4,368,875 | 1/1983 | Weiss et al. | 256/65 X |
| 4,414,920 | 11/1983 | Richard et al. | 119/29 |
| 4,729,453 | 3/1988 | Lyons, Sr. | 182/106 |
| 4,946,139 | 8/1990 | Tomellini | 256/64 |
| 5,427,341 | 6/1995 | Gutgsell | 248/188 |
| 5,484,223 | 1/1996 | Saito | 403/329 |
| 5,617,697 | 4/1997 | Erwin | 256/DIG. 5 X |
| 5,649,690 | 7/1997 | Kilmer | 256/35 |
| 5,690,583 | 11/1997 | Keusch | 482/16 |
| 5,816,733 | 10/1998 | Ishikawa et al. | 403/329 |
| 5,839,846 | 11/1998 | Shimada et al. | 403/164 |
| 5,898,172 | 4/1999 | Masui et al. | 250/239 |
| 5,961,101 | 10/1999 | Anticole | 256/24 |
| 5,967,093 | 10/1999 | Vitt et al. | 119/705 |

FOREIGN PATENT DOCUMENTS

| | | | |
|---|---|---|---|
| 1552218 | 11/1967 | France | 256/24 |

*Primary Examiner*—Lynne H. Browne
*Assistant Examiner*—Ernesto Garcia
*Attorney, Agent, or Firm*—Thomas Schneck

[57] ABSTRACT

A portable stanchion in which a tubular base and tubular post are in interlocking relation. The base is formed of semi-rigid material and has two parallel L-shaped kerfs defining a flexible L-shaped tang which carries the tongue. The spacing of the kerfs matches a cross sectional dimension of the lowermost hollow portion of the post allowing a first foot portion of the post to fit inside of the base. The flexible tang and tongue pivot, when urged by application of an impulsive force, to allow insertion of the first foot portion into the base, while the adjacent second foot portion is outside of the base. The base and post are disassembled also by application of an impulsive force, providing a knock down structure for shipping and storage. A pair of similar stanchions will support a fence segment to form a jump wing. A pair of jump wings will support a jump bar for horse jumping.

15 Claims, 6 Drawing Sheets

PORTABLE STANCHION HAVING INTERLOCKING BASE

TECHNICAL FIELD

This invention relates to a supported portable stanchion and specifically to a knock-down portable stanchion with separable base and post.

BACKGROUND OF THE INVENTION

In an equestrian sport jumping event, a horse is required to jump over obstacles. Such obstacles are often comprised of a structure having a horizontal bar held at a selected height between two upright posts. Typically two or more posts are joined together to form a jump wing that holds the bar. The bar is held such that if the horse is not able to clear the horizontal bar in a jump, the bar will be knocked free from its supports. Commonly, jump wings are wooden obstacles with movable cross bars constructed in an equestrian arena. Such jump wings are often heavy and bulky, making the structure difficult to transport or ship. As a result of their bulk, these structures are more commonly constructed on site rather than being purchased and installed at a remote location. In addition, the structures take up space in the arena and are difficult to remove when the arena is used for other purposes. Jump wings, as part of an arena, are subject to the weather causing deterioration and requiring frequent maintenance to keep the structures looking presentable.

Some improvements to the currently used structures have been proposed. U.S. Pat. No. 4,368,875 describes a device for holding horizontal cross bars to create an obstacle for equestrian jumping events. The device includes upright posts, each post having a guide rail with a series of holes drilled along the vertical length of the guide rail. The pole support is slidably installed on the guide rail and is fixed into a vertical position by a spring biased bolt. U.S. Pat. No. 4,946,139 teaches a modular device that can be linked together by means of T-joints into an equestrian obstacle. A framework of polymeric tubes connected by T-joints are used as upright support for the vertical post.

It is the object of the present invention to provide a portable stanchion for use in making equestrian jump wings that is durable, sufficiently lightweight to transport, and can be partially disassembled to aid in transport and shipping.

SUMMARY OF THE INVENTION

The above object is achieved with a portable stanchion having an elongated tubular base which interlocks with an elongated upright post. The base is formed of a semi-rigid material, such as plastic, with two parallel L-shaped kerfs defining an L-shaped tang between the kerfs which is able to flex independently from the remainder of the base which remains rigid. The tang carries a tongue which projects outwardly from the base and is able to move rearwardly when the tang flexes.

The elongated upright post has a rectangular cross-section with a hollow lowermost portion split by a longitudinal cut into first and second foot portions. The first foot portion is truncated at its lowermost extent to be shorter than the second portion with dimensions such that the first portion will fit through the L-shaped kerfs of the base when the tang and tongue move rearwardly. In this manner the first foot portion fits inside of the base and the second foot portion is outside of the base adjacent to the first foot portion. The post has a slot at the elevation of the tongue, with dimensions to receive the tongue so that the post locks to the base.

In order to engage the base and post, the first foot portion of the post is guided into position between the kerfs of the base. Then the base is hit smartly with the palm of the hand, causing the tang to momentarily spring back allowing the tongue to find and fit into the slot. To disengage the base and post, the reverse procedure is used and the base is hit smartly with the palm, causing the tang again to momentarily spring back allowing the tongue to pop out of the slot, thereby allowing the post to be removed from the base.

A pair of posts can be provided with large ports to accommodate cross rails of a fence so that a fence panel can be supported between posts, thereby forming a jump wing for equestrian events. One of the posts of the pair can be provided with a set of holes to support a guide member for a cup which holds an end of a jump bar. Two jump wings configured in this manner will support a jump bar.

BEST MODE OF CARRYING OUT THE INVENTION

Figure 1:
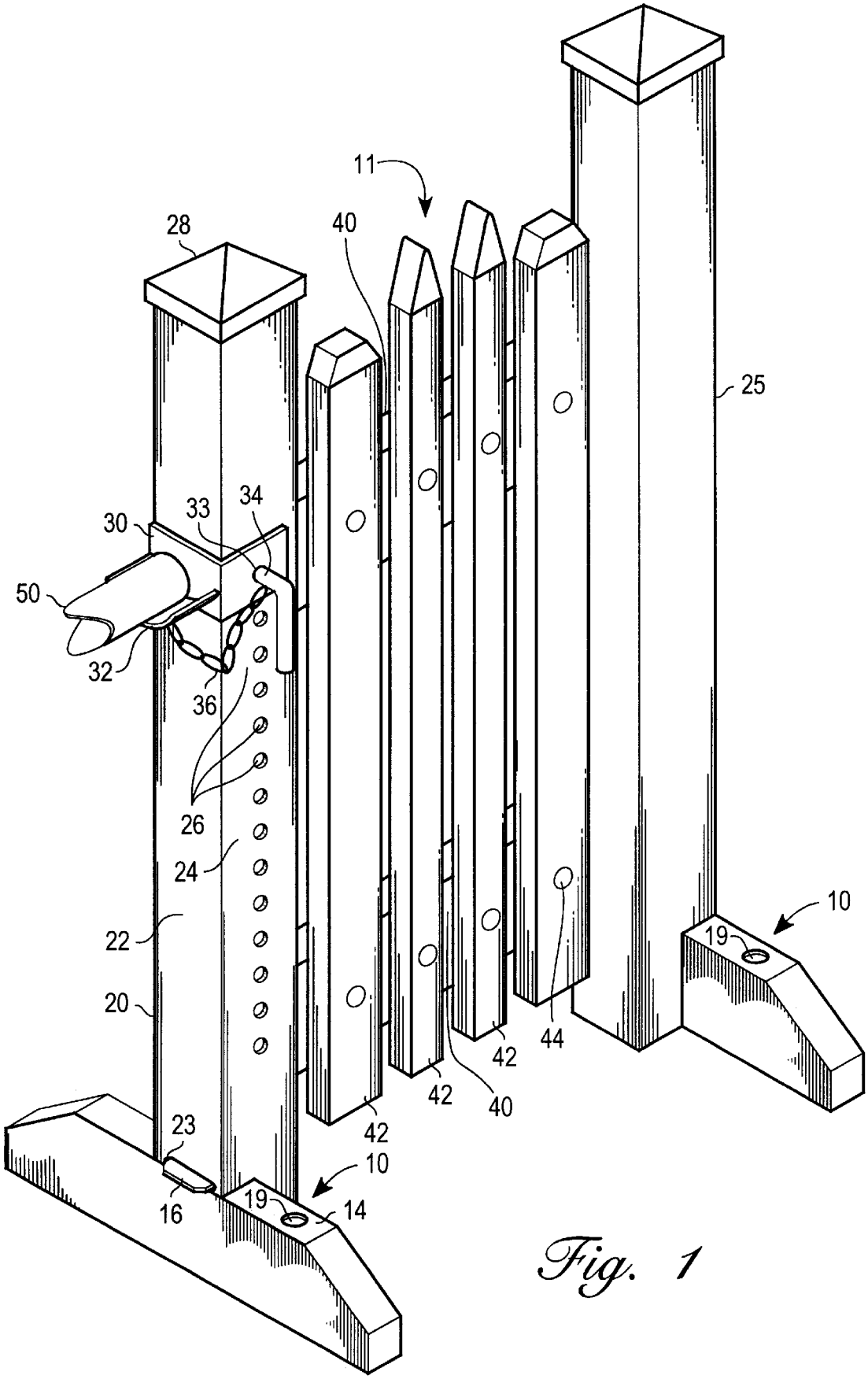
FIG. 1 shows a perspective of a jump wing including two posts with removable bases.

With reference to FIG. 1, jump wing 11 is comprised of two upright, elongated posts 20, 25, each with a detachable base 10, two parallel, spaced apart cross rails 40 extending between the posts, and a guide 30 for supporting a horizontal jump bar 50 supported from one of the posts 20. Each post 20, 25 is supported on the ground by a rectangular, tubular base 10. The base 10 is a closed structure, preferably of a semi-rigid material, such as plastic-like common polyvinyl chloride having a material thickness of about 3 mm, which can be filled with removable ballast, such as water or sand, through fill hole 19. Alternatively, in the interior of each base, a weight, such as a wood block, can be added at each end of each base 10 for added stability in a manner wherein the tongue will not interfere with the weight. A pair of parallel cuts through each base 10 leave two parallel kerfs joined by a perpendicular kerf that allow the base to receive the post 20 as described below.

Base 10 is interlockingly fitted into the bottom of the elongated post 20. Post 20 is also made of a hollow material, preferably polyvinyl chloride of the same type as the base. Capping post 20 is post cap 28. Cut through front post wall 22 of post 20 is slot 23. Into slot 23 fits tongue 16 on base 10. By placing tongue 16 through slot 23, post 20 and base 10 are interlockingly fastened together. Base 10 is removable from post 20 by applying a sufficient impulse to base 10 to cause tongue 16 to flex out of slot 23. The base can then be separately stored and transported or oriented along the side of post 20, i.e. so that the two members are parallel to each other for stacking so that the base and post are more compact for storage and shipping.

On first side post wall 24 and on the opposite side post wall of post 20 a series of holes 26 have been drilled at regular intervals. These holes allow a guide 30 to be held against the side of post 20. Guide 30 slidably fits across front post wall 22 and partially across first side post wall 24 and the back post side. A pin 34 slides through a guide hole 33 to retain guide 30. Pin 34 can be adjustably positioned in any of the guide holes. Mounted on the side of the guide that extends across front post wall 22 is support cup 32 which holds the jump bar 50. The shallow curve of cup 32 allows the pole to be knocked from the cup 32 if the jump bar is struck by a hoof. A chain 36 secures bar 34 to guide 30.

Cross rails 40 extend between first post 20 and second post 25 to form the jump wing. Ports are cut into post 20 to hold cross rails 40 and rivets can be used to secure cross rail 40 onto first post 20 and second post 25. Attached by screws 44 to cross rails 40 are pickets 42.

Figure 2A:
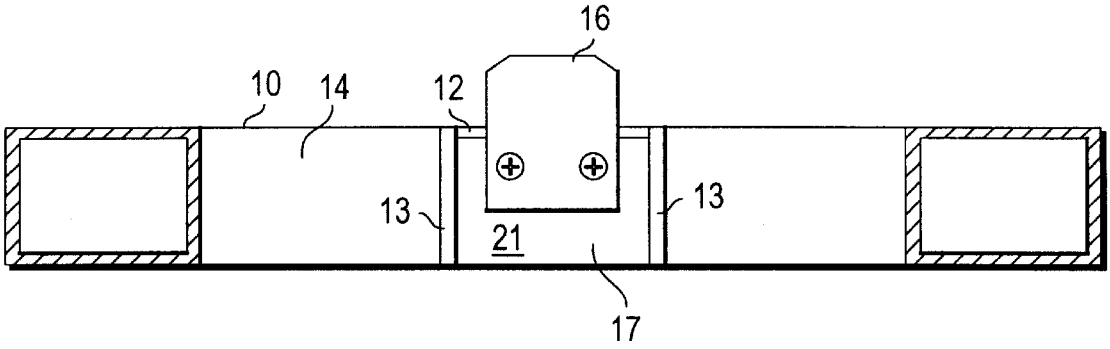
FIG. 2A shows a top view of a base for supporting a post shown in FIG. 1.

In FIG. 2A, base 10 is shown having two parallel kerfs 13 cut through the hollow material of the base. Kerfs 13 extend across the width of base 10 and are joined by a perpendicular kerf 12 along a length of the front edge of base 10. The width of kerfs 13 is at least equal to the thickness of the material comprising the sides of hollow post 20, i.e. 3 mm. The distance separating the two parallel kerfs that extend across the top of base 10 is equivalent to the distance between first side post wall 24 and the opposite second side post wall. Attached to the top of base top 14 by screws is tongue 16 which extends outwardly beyond kerf 12.

Figure 2B:
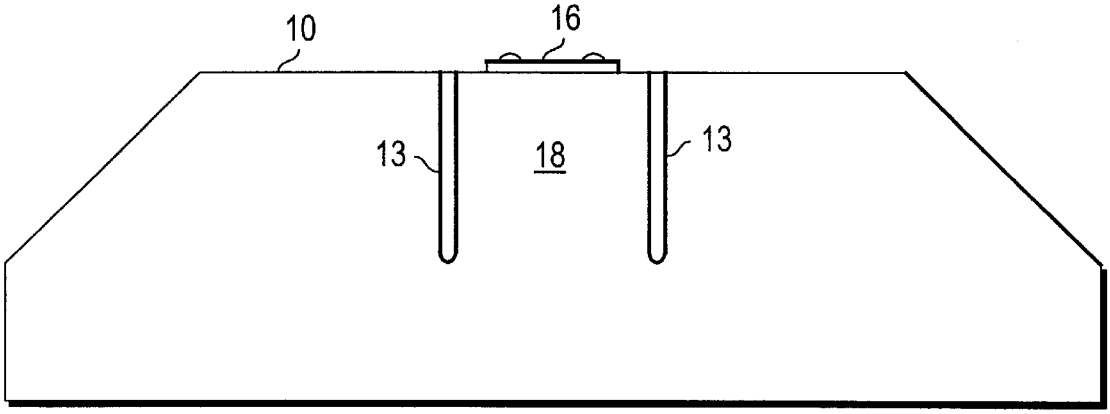
FIG. 2B shows a back side view of the base shown in FIG. 2A.
Figure 2C:
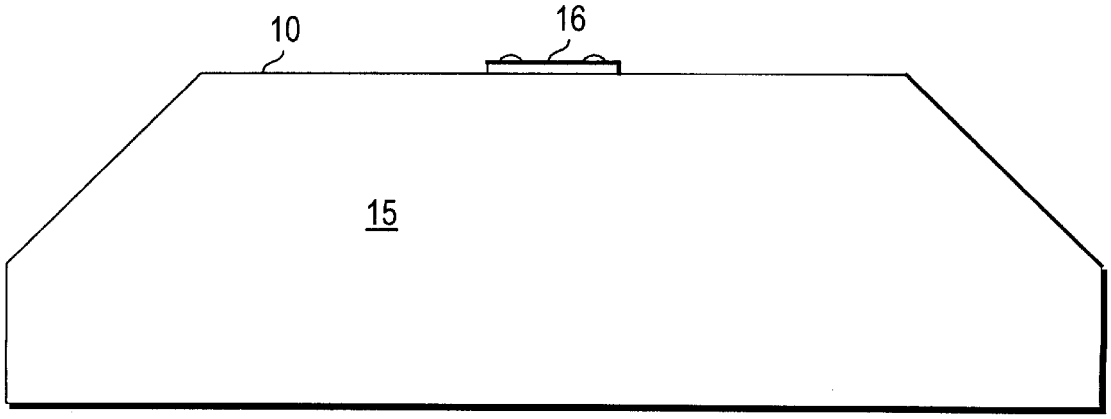
FIG. 2C shows a front side view of the base shown in FIG. 2A.

In FIG. 2B, the rear view of base 10 shows that the kerfs 13 are L-shaped. Kerfs 13 extends partially down the back side of base 10 again in equal parallel lengths separated by a width equal to the distance separating side post walls. Kerfs 13 thus define on base 10 two L-shaped cuts, joined together, defining therebetween a broad L-shaped tang 17. The tang has an upright portion, seen in FIG. 2B, and a transverse portion 21, seen in FIG. 2A. The lower end of the upright portion corresponds to the upper tip of the L-shape and serves as the pivot region for the tang. Because base 10 is composed of a semi-rigid plastic material, which may be filled with a yieldable material, such as sand or water, this L-shaped tang 17 can flex back. FIG. 2C shows the front view of base 10 with front side 15. Front side 15 fits in front of front post wall 22. Tongue 16 attached to the transverse portion of the L-shaped tang 17 and thus is able to flex back away from front post wall 22 when the base is inserted into post 20.

Figure 3:
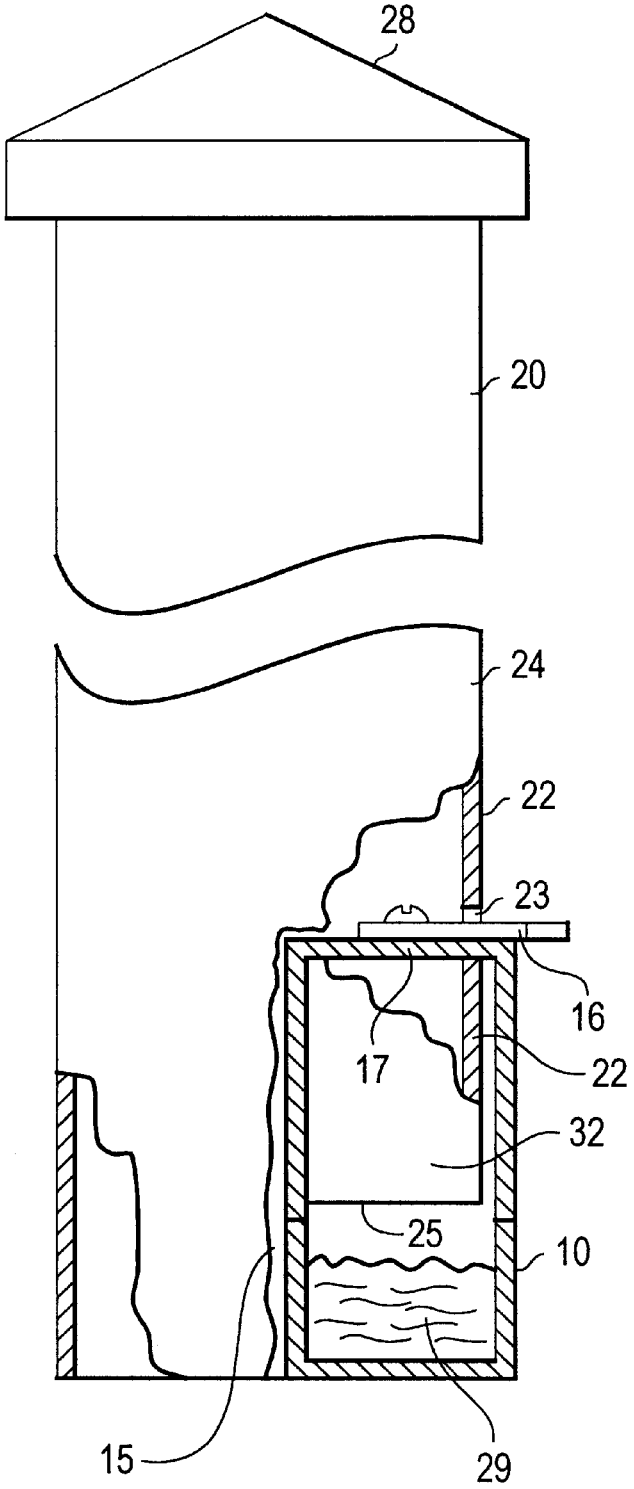
FIG. 3 shows a partial side cutaway of a post and base shown in FIG. 1.

In FIG. 3, base 10 is inserted into post 20. The bottom of post 20 has a truncated portion 32 allowing the bottom of base 10 to be flush with the bottom of post 20, forming a level bottom surface. Opposed post side walls each have symmetrical cuts 5 extending from the inner edge of truncated portion 32 such that the symmetrical cuts of the post mate with the L-shaped cuts of the base. Tongue 16 is able to flex against front post wall 22 because of the flexible L-shaped tang 17 on which tongue 16 is mounted. Once tongue 16 is fitted through slot 23 the L-shaped tang 17 will flex back and securely hold base 10 onto post 20. Water ballast 29 is seen filling the lower portion of base 10.

The base and post used in the present invention are surprisingly stable when assembled yet easy to assemble and disassemble. To insert the base into the post simply requires fitting tongue 16 onto the inner side of front post wall 24 and sliding the base 10 into the post 20 until tongue 16 locks into slot 23, which requires a slap with the palm of the hand. To remove base 10 from post 20 simply requires a sufficient impulse on the base 10 to jar tongue 16 out of slot 23. A sudden sharp slap is most effective.

Figure 4:
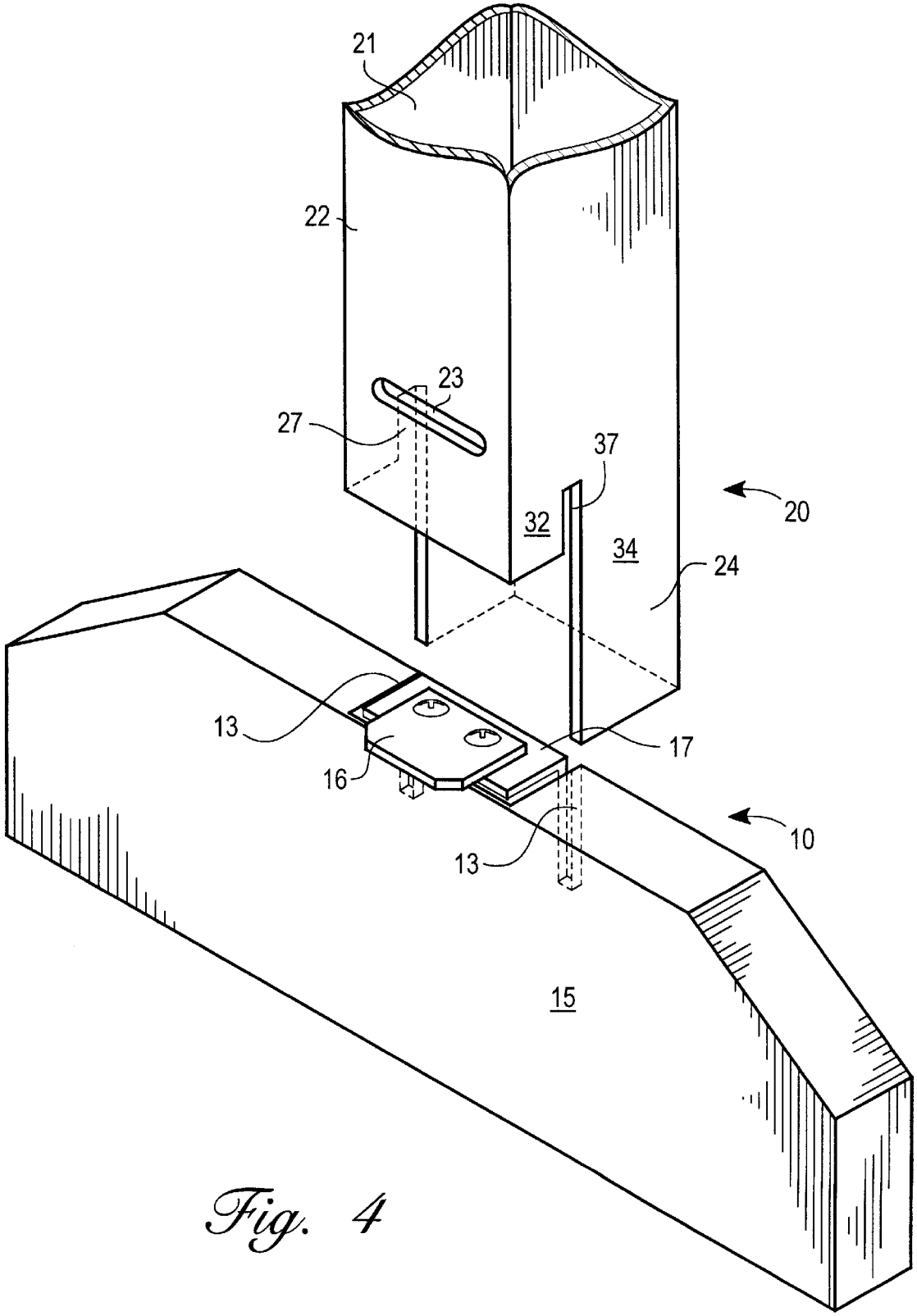
FIG. 4 is a perspective view of a detail of a post and base shown in FIG. 1 with the post removed from the base.

FIG. 4 illustrates the base 10 prior to insertion into the bottom of post 20. The post sides 21 and 24 have post side grooves 37 and 27 extending partially up the post dividing the foot of the post into two sections 32 and 34. Grooves 37 and 27 are symmetrically oriented and positioned parallel to post face side 22 far enough back so that the section 32 with the truncated lowermost portion fits within the width of base 10. Now one section 32 is inside of the base and another section 34 is outside of the base. Grooves 37 and 27 on post 20 mate with kerfs 13 on base 10.

Figure 5:
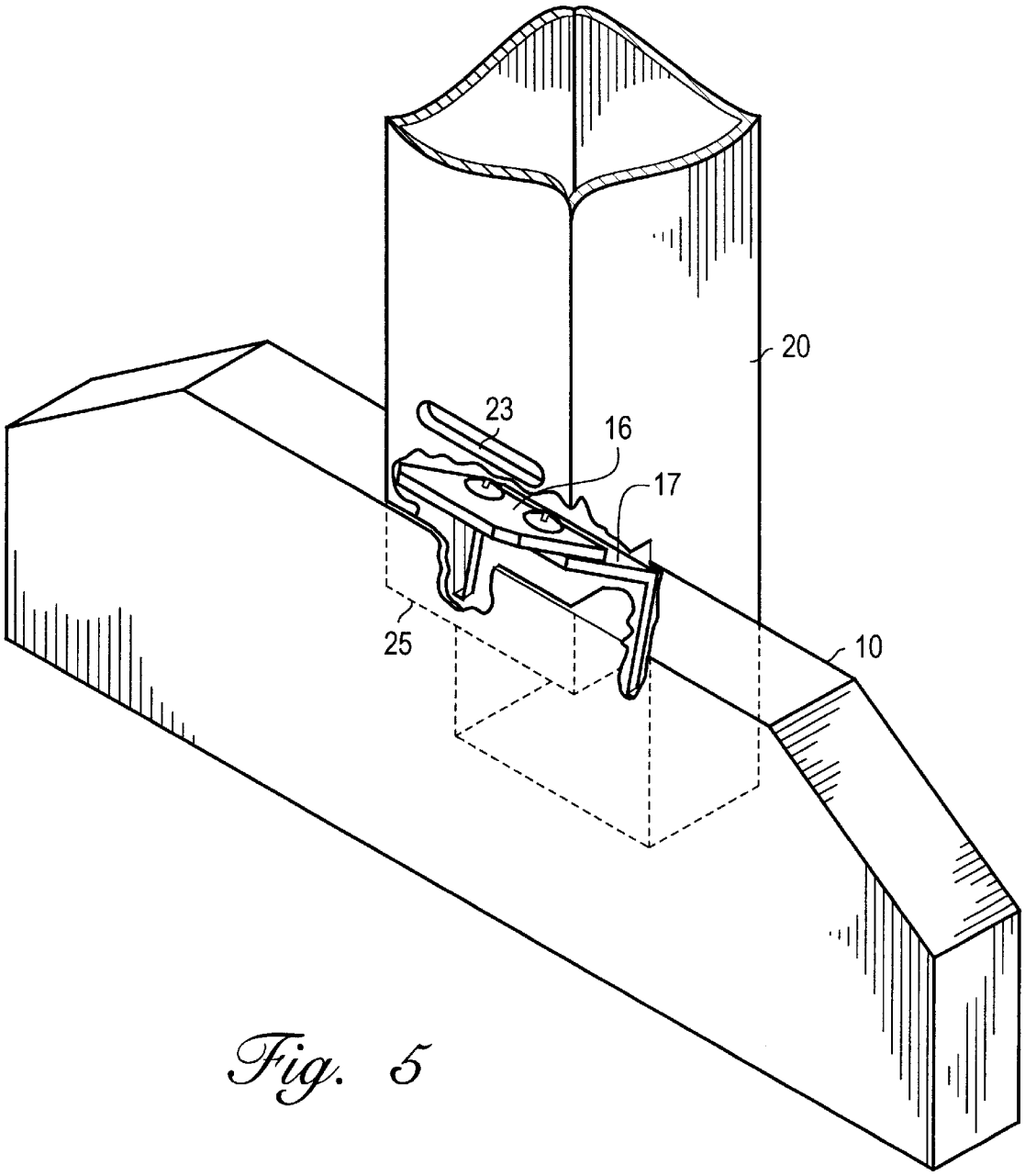
FIG. 5 is a perspective view of the post and base of FIG. 4 showing the joiner of the post and base.
Figure 6:
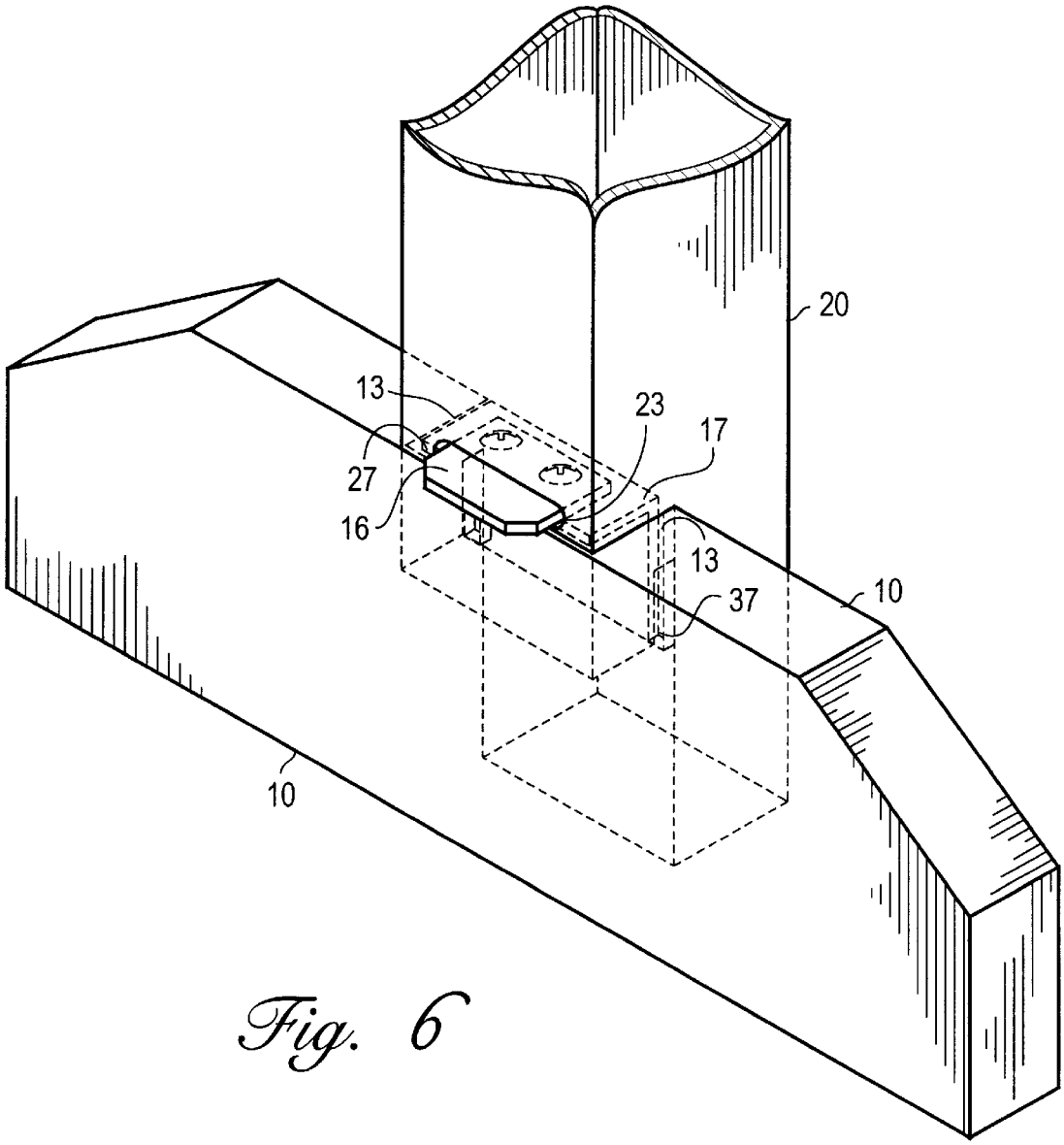
FIG. 6 shows the post and base of FIG. 4 with the post fully inserted into the base.

FIG. 5 shows base 10 partially inserted into post 20. The L-shaped tang 17 on base 10 flexes to fit tongue 16 into the slot 23 of post 20. In FIG. 6, the base 10 has been fully inserted into post 20. Cuts 37 and 27 are interlocked with kerfs 13 to give the post additional stability. Tongue 16 extends through slot 23 allowing L-shaped tang 17 to flex back into its original orientation. In this position, base 10 securely holds post 20.

In this patent application the terms "kerfs" and "cuts" imply sawing of the post and base. However, a sawing process is only exemplary and other fabrication techniques should be regarded as equivalent.

I claim:

1. A portable stanchion comprising, an elongated tubular base made of semi-rigid material having two parallel L-shaped kerfs extending through the material, the kerfs extending partially up one side of the base, and across the top of the base, with the two kerfs joined along an upper surface of the base, and an elongated post having two co-extensive cuts through the material on the bottom of opposing sides of the post, the cuts extending up the post for a length equal to a dimension of the kerfs in the base, thereby dividing the bottom of the post into two portions, including a first portion which fits through the kerfs so that the first portion is inside of the base and a second portion outside of the base, thereby holding the post fixed relative to the base.

2. The portable stanchion of claim 1 further comprising, a tongue extending from the top of the base transverse to a joinder of the kerfs whereby the tongue member is able to move by flexing of a base section between the kerfs, and a slot defined in a side of the post near the bottom thereof for snugly receiving the tongue therein, thereby temporarily locking the base to the post.

3. The portable stanchion of claim 1 further comprising ballast material disposed within the tubular base.

4. The portable stanchion of claim 3 wherein the ballast material is water.

5. The portable stanchion of claim 3 wherein the ballast material is sand.

6. The portable stanchion of claim 3 wherein the ballast material is wood.

7. The portable stanchion of claim 1 further comprising, pairs of holes symmetrically disposed along an extent of the post, a guide having a retractable securing device fitting into a pair of holes, and a cup mounted on the guide for supporting an end of a horizontal pole.

8. The portable stanchion of claim 1 further defined by a second identical stanchion, with a fence between stanchions thereby forming a portable jump wing.

9. The portable stanchion of claim 4 further defined by a second identical stanchion supporting a second end of said pole, thereby forming a jump stand.

10. The portable stanchion of claim 1 wherein the semi-rigid material is polyvinyl chloride.

11. A portable stanchion comprising, an elongated tubular base made of a semi-rigid material having a pair of parallel spaced apart L-shaped kerfs defining a flexible tang to which a tongue is connected such that the tongue flexes relative to the base, and an upright post with a rectangular cross section at a lower end thereof with opposed cuts dividing the lowermost portion of the post into first and second sections, the first section fitting into the base along said kerfs and the second section disposed outside of the base, the post having a slot into which the tongue fits, thereby locking the post to the base.

12. The portable stanchion of claim 11 further comprising ballast material disposed within the tubular base.

13. The portable stanchion of claim 11 further defined by a second identical stanchion, with a fence between stanchions thereby forming a portable jump wing.

14. A portable stanchion comprising, an elongated tubular base formed of a semi-rigid material, having a rectangular cross-section with a length and a width and having an inverted L-shaped tang partially cut out of the base, leaving two parallel L-shaped kerfs in the semi-rigid material, the L-shape of the tang having an upright portion joined to a transverse portion, the upright portion joined to the base and the transverse portion having a tongue member joined thereto projecting outwardly along the widthwise dimension of the base, whereby the tongue member is able to move rearwardly by flexing of the upright portion of the tang and forwardly by spring action of the semi-rigid material, an elongated upright post having a rectangular cross-section, a base of said upright post having a hollow lowermost foot portion split by a cut into the first and second portions, the first portion being truncated at the lowermost extent of the post relative to the second portion, with dimensions so that the first portion will fit through the L-shaped kerfs of the base when the tang and the tongue are moved rearwardly so that the first portion fits inside of the base and the second portion is outside of the base, the post having a slot at the elevation of the tongue of the base with dimensions and orientation to receive the tongue thereby temporarily locking the base to the upright post.

15. The portable stanchion of claim 14 further comprising ballast material disposed within the tubular base.

* * * * *